United States Patent [19]

Kori et al.

[11] 4,301,228

[45] Nov. 17, 1981

[54] ELECTROGRAPHIC DEVELOPING MATERIAL AND DEVELOPING METHOD EMPLOYING SAID DEVELOPING MATERIAL

[75] Inventors: Toshitaro Kori, Tondabayashi; Tateki Oka, Sakai, both of Japan

[73] Assignee: Minolta Camera Kabushiki Kaisha, Japan

[21] Appl. No.: 134,131

[22] Filed: Mar. 26, 1980

[30] Foreign Application Priority Data

Dec. 26, 1979 [JP] Japan ..... 54/171081

[51] Int. Cl.[3] ..... G03G 9/14

[52] U.S. Cl. ..... 430/122; 430/110; 430/108

[58] Field of Search ..... 430/10 S, 122

[56] References Cited

U.S. PATENT DOCUMENTS

| | | | |
|---|---|---|---|
| 3,262,806 | 7/1966 | Gourge | 430/107 |
| 3,392,139 | 7/1968 | Durgman | 430/109 |
| 3,720,617 | 3/1973 | Chatterji et al. | 430/108 |
| 3,819,367 | 6/1974 | Chatterji et al. | 430/108 |
| 4,039,463 | 8/1977 | DeRoo | 430/110 |

FOREIGN PATENT DOCUMENTS

| | | | |
|---|---|---|---|
| 1522667 | 10/1969 | Fed. Rep. of Germany | 430/111 |
| 54-13463 | 6/1979 | Japan . | |

*Primary Examiner*—John D. Welsh

*Attorney, Agent, or Firm*—Wenderoth, Lind & Ponack

[57] ABSTRACT

A developing material for use in electrography which includes electrically insulative toner particles mainly composed of coloring material, dye and thermoplastic resin, carrier particles arranged to be triboelectrically charged to the polarity opposite to that of the electrically insulative toner particles through frictional contact with the electrically insulative toner particles, and electrically insulative fine particles composed of metallic oxide. The electrically insulative fine particles are arranged to be triboelectrically charged to the polarity opposite to the charged polarity of the electrically insulative toner particles through frictional contact with the electrically insulative toner particles and not to be triboelectrically charged even upon their frictional contact with the carrier particles.

7 Claims, 11 Drawing Figures

ELECTROGRAPHIC DEVELOPING MATERIAL AND DEVELOPING METHOD EMPLOYING SAID DEVELOPING MATERIAL

BACKGROUND OF THE INVENTION

The present invention generally relates to a developing material for use in electrography and a developing method utilizing said developing material, and more particularly, to a developing material in powder form for developing electrostatic latent images including electrically insulative toner particles and carrier particles, and a developing method for developing the electrostatic latent images employing said developing material.

Conventionally, there have been widely employed for actual applications, electrophotographic copying apparatuses which utilize two or dual-component developing materials such as the developing material for cascade development including carrier particles, for example, a glass beads and the like and electrically insulative toner particles, or the developing material for magnetic brush development composed of carrier particles of iron particles and the like and electrically insulative toner particles, etc. In the known copying apparatuses of the above described type, the development is effected either by cascading over the electrostatic latent image, the carrier particles and toner particles electrostatically attracted to each other by triboelectrical charging arising from mixing and stirring of said two particles, or by rubbing against the electrostatic latent image, the carrier particles and toner particles arranged in the form of magnetic brush through magnetic force. In the above case, however, although the toner particles in the developing material adhere to the image-formed portions by the electrostatic force of the latent image so as to be consumed thereby, the carrier particles are repeatedly used as they are without being consumed, and thus, when the developing material is used for a long period, part of the toner which does not directly contribute to the developing or the so-called "spent" toner tends to be undesirably fused over the surfaces of the carrier particles, with consequent reduction in the performance of the carrier particles which subject the toner particles to triboelectrical charging, thus resulting in adverse effects on the image quality such as reduction in density of the developed images, generation of fogging, etc.

Accordingly, in the conventional developing materials as described above, it has been necessary to replace the used developing material with a fresh one before the above adverse effects take place, for example, after developing electrostatic latent images equivalent in areas to 15,000 sheets of A4 size copy paper in a commercially available desk top type electrophotographic copying apparatus.

In order to overcome the disadvantages as described above, there has conventionally been proposed, for example, in Japanese Patent Application No. Tokugansho 53-105214 (corresponding U.S. application No. 949,426 filed Oct. 5, 1978, Kenji TABUCHI et al.) a dual-component developing material employing carrier particles of small diameter which are prepared by bonding magnetizable fine particles with resin, instead of the carrier of iron particles. The proposed developing material as described above is advantageous in that, owing to the small diameters (normally 5~30 μ) of the carrier particles, the fusion of the "spent" toner onto the surfaces of the carrier particles does not readily occur, with a consequent marked prolongation of the life (i.e. the period after which the used developing material must be disposed of) of the developing material, but the undesirable phenomenon regarding the fusion of the "spent toner" over the carrier particle surfaces still can not be avoided, and the developing material has drawbacks similar to those in the conventional dual-component developing materials in that it must undesirably be disposed of upon starting of fusion of the "spent" toner.

As a result of various studies made by the present inventors to prevent the fusion of the "spent" toner onto the surfaces of the carrier particles, it has been found that addition of electrically insulative fine particles or powder, for example, metallic oxides such as silica, alumina and the like into the developing material as a third component is effective for this purpose. Although the addition of the electrically insulative fine particles as described above is very effective for preventing the fusion of the "spent" toner to achieve long life of the developing material, there still arises a phenomenon similar to the fusion of the "spent" toner onto the surfaces of the carrier particles due to adhesion of the electrically insulative fine particles onto said carrier particle surfaces through triboelectrical charging therebetween, thus resulting in reduction of the life of the developing material by the deterioration in the performance of the carrier, contrary to the purpose of the addition in some cases.

SUMMARY OF THE INVENTION

Accordingly, an essential object of the present invention is to provide an improved developing material of the triple-component type for use in electrophotography which has a long life, with a stable performance and a high reliability through employment of electrically insulative fine particles which are triboelectrically charged to polarity opposite to charged polarity of electrically insulative toner particles, through frictional contact with the electrically insulative toner particles and are not to be triboelectrically charged even upon frictional contact thereof with carrier particles, with substantial elimination of disadvantages inherent in the developing materials of the kind.

Another important object of the present invention is to provide a developing material of the above described type which is stable in performance and simple in structure, and can be manufactured on a large scale at low cost.

A further object of the present invention is to provide a developing method which is capable of carrying out efficient development at high quality through utilization of the developing material of the above described type.

In accomplishing these and other objects, according to one preferred embodiment of the present invention, there is provided a developing material for use in electrophotography which includes electrically insulative toner particles mainly composed of coloring material, dye and thermoplastic resin, carrier particles mainly composed of magnetizable particles and bonding material and arranged to be triboelectrically charged to opposite polarity to that of the electrically insulative toner particles through frictional contact with said electrically insulative toner particles, and electrically insulative fine particles composed of metallic oxide. The electrically insulative fine particles are arranged to be triboelectrically charged to polarity opposite to charged polarity of the electrically insulative toner particles through frictional contact with the electrically insulative toner particles and not to be triboelectrically charged even upon frictional contact thereof with said carrier particles.

By the compositions according to the present invention as described above, the improved developing material of triple-component type is advantageously realized wherein the undesirable adhesion of electrically insulative fine particles onto the surfaces of carrier particles is eliminated, with consequent long life and high performance of the developing material.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
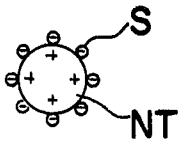
FIGS. 1(A) to 1(G) are schematic diagrams explanatory of behavior of electrically insulative fine particles employed in the developing material according to the present invention.
Figure 1:
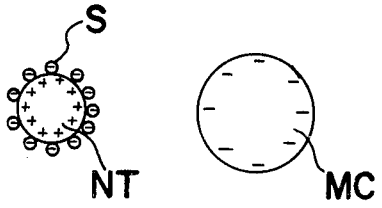
Figure 1:
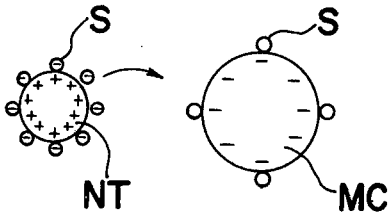
Figure 1:
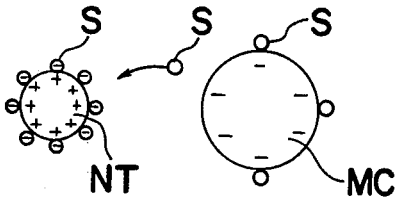
Figure 1:
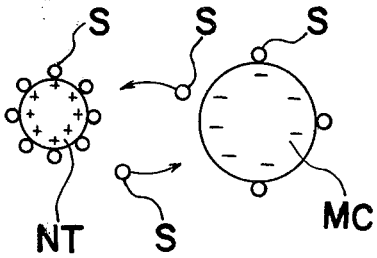
Figure 1:
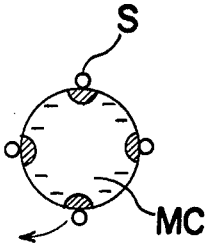
Figure 1:
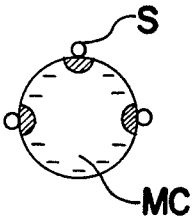

In the first place, it is to be noted that the developing material according to the present invention comprises electrically insulative toner particles mainly composed of coloring material, dye and thermoplastic resin, carrier particles mainly composed of magnetizable particles and bonding material and arranged to be triboelectrically charged to a polarity opposite to that of the electrically insulative toner particles through frictional contact with said electrically insulative toner particles, and electrically insulative fine particles composed of metallic oxide which are arranged to be triboelectrically charged to polarity opposite to charged polarity of the electrically insulative toner particles through frictional contact with said electrically insulative toner particles and not to be triboelectrically charged even upon frictional contact thereof with said carrier particles.

In the above structure of the developing material according to the present invention, it should particularly be noted that the electrically insulative fine particles are arranged not to be triboelectrically charged even upon frictional contact thereof with said carrier particles, although triboelectrically charged to be polarity opposite to the polarity of the charge of said electrically insulative toner particles through frictional contact thereof with said electrically insulative toner particles.

Referring now to the drawings, the present invention will be described in detail hereinbelow.

For the electrically insulative toner particles mentioned above, those having volume resistance higher than $10^{-}\Omega\cdot$cm and average particle diameter of 2 to 30 $\mu$m and more preferably, of 5 to 25 $\mu$m are particularly suitable. Meanwhile, for the coloring material, dye and thermoplastic resin which are the main components of the electrically insulative toner particles, those commercially available may be employed as they are. For example, as the thermoplastic resin, one which is used as the bonding agent of the carrier particles to be mentioned in detail later may be adopted. To prepare the electrically insulative toner particles, the coloring material and dye are normally added respectively at the rate of 2 to 20 weight parts to 100 weight parts of the thermoplastic resin. As the coloring material, carbon black such as furnace black, acetylene black, etc. may normally be employed, but is is to be noted that, if the coloring material is less than 2 weight parts, intended results can not be achieved, while on the contrary, if the amount thereof exceeds 20 weight parts, the volume resistance is lowered, with consequent reduction of charge amount by the frictional contact between the toner particles and carrier particles, thus giving rise to deterioration of image quality and the like. The dye to be added for the purpose of charge control besides coloring may be suitably selected depending on whether a positive charge or a negative charge is imparted to the toner particles. Dyes for imparting a positive chargeability are represented by oil-suitable dyes such as nigrosine group oil black, crystal violets, etc., while those for imparting a negative chargeability are represented by metal complex dyes such as polatine dyes, orazol dyes, etc. The dye to be added as described above can not fully display the expected effect at the amount less than 2 weight parts, and if the amount thereof exceeds 20 weight parts, deterioration of image quality results due to excessive reduction of charge amounts of the toner particles and carrier particles. The average particle diameter of the electrically insulative toner particles is determined to be 2 to 30 $\mu$m and more preferably, to be 5 to 25 $\mu$m because, if the diameter is less than 2 $\mu$m, the fluidity is markedly reduced and dust is generated in a large quantity so as to be unsuitable for actual application, while the image quality is reduced due to roughness of the images, if the diameter exceeds 30 $\mu$m. Meanwile, the volume resistance is set to be higher than $10^{14}$ $\Omega\cdot$cm to make it possible to achieve favorable image transfer with respect to transfer paper of low resistance or even under high humidity.

For the carrier particles, those having volume resistance higher than $10^{12}$ $\Omega\cdot$cm, and average particle diameter of 5 to 40 $\mu$m and more preferably, of 15 to 25 $\mu$m are suitable. The above carrier particles are mainly composed of magnetizable powder and bonding material, with carbon being added thereto depending on necessity as electrical charging control agent or electrical resistance control agent. For the magnetizable powder and bonding material which are the main components of the carrier particles, known materials normally used may be employed. For example, fine particles of magnetite, ferrite, pure iron, etc. having average particle diameter of less tha 3 $\mu$m and more preferably, of less than 1.5 $\mu$m may be favorably employed for the magnetizable powder. Meanwhile, for the bonding material, heat-hardening resins such as modified acrylic resin, phenolic resin, melamine resin, urea resin, etc.

may be employed besides thermoplastic resins such as polystyrene, polyethylene, polypropylene, vinyl group resin, polyacrylate, polymethacrylate, polyvinylidene chloride, polyacrylonitride, polyether, polycarbonate, thermoplastic polyester, cellulose group resins and monomer copolymer resins thereof, etc. The mixing ratio of the bonding material to the magnetizable powder which has a large influence on the magnitude of magnetization of the carrier particles requires special attention, and should normally be 67~300 weight parts and more preferably, 150~300 weight parts of the magnetizable powder to 100 weight parts of the bonding material. The above ratio is determined based on the finding that, if the magnetizable powder is less than 67 weight parts, sufficient magnetism can not be obtained, with consequent deterioration in the transporting nature, while on the contrary, if it exceeds 300 weight parts, ample bonding ability may not be achieved due to excessively small amount of the bonding material, thus making the particles undesirably fragile. On the other hand, the carbon to be added depending on necessity should preferably be suppressed to less than 15 weight parts in its ratio with respect to 100 weight parts of the bonding agent for maintaining the volume resistance of the carrier particles higher than $10^{12}\Omega\cdot$cm. The average particle diameter of the carrier particles affects the image quality, charging amount and transporting nature of said carrier particles in such a manner that, if the average particle diameter thereof is less than 5 μm, the transportability is deteriorated, while if it exceeds 40 μm, copied images tend to become rough in grain, resulting in lowering of image quality.

The toner particles and carrier particles may be mixed at any weight ratio in the region from 2(toner particles):98 (carrier particles to 50:50 and more preferably, from 6:94 to 35:65 on the assumption that the total amount is 100, but attention should be directed to the fact that, if the amount of the toner particles is less than 1 wt%, the image density is insufficient, while on the contrary, if it exceeds 50 wt%, a large amount of dust of the toner particles tends to be generated.

The electrically insulative fine particles to be added as a third component to the developing material according to the present invention are of metallic oxides such as silica, alumina, etc., and those having the average diameter of primary particles less than 0.1 μm are particularly suitable. The electrically insulative fine particles as described above are so selected as to be ones which are triboelectrically charged, by being brought into contact with the electrically insulative toner particles, to the polarity opposite to that by which said toner particles are triboelectrically charged upon frictional contact of said toner particles with said carrier particles, but which are not triboelectrically charged even when brought into frictional contact with said carrier particles, and added at the ratio of 0.05~1.0 weight parts with respect to 100 weight parts of the toner particles for mixing therebetween. The mixing ratio as described above is determined based on the finding that, if the amount of the electrically insulative fine particles is of less than 0.05 weight part, prolongation of life of the developing material can not be achieved, while if said amount thereof exceeds 1.0 weight part, the charge amount of the developing material becomes so small as not be usable for the developing purpose due to generation of dust, etc. In the normal developing, since the toner particles are arranged to be charged to the polarity opposite to that of the electrostatic latent image, the elecrically insulative fine particles are so selected as to be charged to the same polarity as that of the electrostatic latent image, but in the case of reversal development, the toner particles are arranged to be cahrged to the same polarity as that of the electrostatic latent image, and therefore, the electrically insulative fine particles are so selected as to be charged to the polarity opposite to that of the latent image. For the electrically insulative fine particles, those commercially available may be employed as they are, representative ones of which are, for example, silica fine particles such as hydrophilic aerosil #200, #300, and hydrophobic aerosil R-972 (names used in trade and manufactured by nippon Aerosil Co., Ltd., Japan), Carplex FPS-3 and FPS-4 (names used in trade and manufactured by Shionogi & Co., Ltd., Japan), Finesil T-32B (name used in trade and manufactured by Tokuyama Soda Co., Ltd., Japan), Syloid (name used in trade and manufactured by Fuji-Davison Chemical Ltd., Japan), and D-17 (name used in trade and manufactured by Degussa Japan), etc. or alumina fine particles such as $Al_2O_3$-C (name used in trade and manufactured by Nippon Aerosil Co., Ltd., Japan).

Although the electrically insulative fine particles as described above are not to be frictionally charged with respect to the carrier particles, they adhere to electrically charged items irrespective of charged polarity thereof owing to their structure in the form of extremely fine particles, and normally adhere to the surfacs of carrier particles in the developing material. However, the adhesion as described above is very weak as compared with electrostatic attraction, and moreover, part of the surfaces of the carrier particles to which the electrically insulative fine particles have adhered is not subjected to frictional contact with respect to the toner particles, while not being charged by the frictional contact with respect to the adhering electrically insulative particles, and thus, gradually loses its charge, so that after all, the electrically insulative fine particles leave said part of the surfaces of the carrier particles. Subsequently, the surfaces of the carrier particles from which the electrically insulative fine particles have departed are again charged by the frictional contact with respect to the toner particles for causing fresh electrically insulative fine particles to adhere thereto. Since the phenomena as described above are repeasted, the fusion of the "spent" toner over the surfaces of the carrier particles is prevented by the electrically insulative fine particles, while simultaneously, fixing of said electrically insulative fine particles to the carrier particles is advantageously prevented, with a consequent prolongation of the life of the developing material. Moreover, as is seen from the foregoing description, since the electrically insulative fine particles behave in such a manner that they adhere to the surfaces of the carrier particles or leave said surfaces to adhere to the toner particles, said electrically insulative particles also act as a stabilizing agent for maintaining the charge of the carrier particles constant at all times. On the other hand, the charged amounts each of the toner particles and carrier particles are reduced or become small in the case where the electrically insulative fine particles are added to the toner particles and carrier particles for mixing and stirring, as compared with the case where only the toner particles and carrier particles are mixed and stirred, and moreover, becomes still smaller as the amount of addition of the electrically insulative fine particles increases. Accordingly, by adjusting the amount of addition of the electrically insulative fine particles, the charge amounts of the toner particles and carrier particles may be controlled to desired values.

On the other hand, for achieving favorable development in the electrostatic latent image developing method, it is required that each of the components in the developing material (i.e. the developing material to be newly loaded in the electrostatic latent image developing apparatus) is uniformly dispersed, while in the case where the life of the developing material is extremely prolonged as in the developing material according to the present invention, for example, when the deveopment of more than 100,000 sheets in A4 size becomes possible as shown in EXAMPLES to be described later, it is necessary to replenish the toner particles to be consumed by the development and electrically insulative fine particles adhering to said toner particles so as to be simultaneously consumed, for preventing reduction of the image density resulting from variation of the mixing ratio of the toner particles to the carrier particles, i.e. reduction of the toner particles. In the above replenishment of the components, respective components in the developing material including the components thus replenished are required to be uniformly dispersed instantaneously.

In the developing material according to the present invention, since the electrically insulative fine particles have such characteristics that, although triboelectrically charged with respect to the toner particles, they are not triboelectrically charged with respect to the carrier particles, it has been found that an extremely long period of time (normally about 40 hours) is required for mixing and stirring when the three components, i.e. the electrically insulative toner particles, carrier particles and electrically insulative fine particles, are to be simultaneously mixed and stirred, and moreover, that when the toner particles and electrically insulative fine particles are replenished as they are into the developing material as replenishing components or replenishing developing agents, uniform distribution particularly of the electrically insulative fine particles is difficult to be effected. As a result of various investigations carried out by the present inventors for solving the above problems, it has been made clear that, although electrically insulative fine particles, for example, silica powder readily cohere in themselves, they become very easily dispersable when triboelectrically charged by mixing thereof with toner particles and the like so as to adhere to the toner particles even by slight stirring for dispersion, with the cohesion thereof being lost, and that when the toner particles and electrically insulative fine particles are individually mixed into the carrier, since the developing material is fundamentally composed of the toner particles and carrier particles, with the carrier particles being larger in amount, the electrically insulative fine particles have, as it were, only a few mates or partners for the triboelectrical charging thereof, with consequent difficulties in the dispersion and adhesion thereof to the toner particles, but that, when the toner particles and electrically insulative fine particles which have both been triboelectrically charged through mixing and stirring are mixed with the carrier particles and stirred, the three components are readily and uniformly dispersed.

Based on the above findings, the present inventors have completed a developing material preparation method as follows. More specifically, the present invention may be said to provide a method of preparing a triple or three-component developing material characterized in that, for preparing the three-component developing material composed of the electrically insulative toner particles, carrier particles and electrically insulative fine particles, the electrically insulative fine particles are subjected to triboelectric charging by mixing and stirring the electrically insulative toner particles and electrically insulative fine particles, with subsequent mixing thereinto the carrier particles for stirring. By the above method, it is possible to extremely quickly obtain the replenishing developing material composed of the toner particles having the electrically insulative fine particles electrostatically atttracted onto their surfaces, by triboelectrically charging the electrically insulative fine particles through sufficient mixing and stirring of the toner particles and electrically insulative fine particles in the process of preparing the developing material. For example, when the toner particles and electrically insulative fine particles are to be mixed and stirred at weight ratio of 99.7:0.3 for uniform dispersion, the mixing and stirring for one hour are sufficient for the purpose, and in the case where the developing material is prepared by adding the carrier particles to the resultant mixed and dispersed material as described above, uniform dispersion of the respective components is achieved in a period of time about ¼ of the time period required for preparing the developing material by simultaneously mixing the three components, and more specifically, in approximately 10 hours. Furthermore, uniform dispersion of the respective components after the replensihing developing material has been supplied to the developing material in which the toner particles and electrically insulative fine particles are decreased, can be achieved in the short time period. Accordingly, by the method as described above, adverse effects such as generation of fogging in the developed images resulting from uneven dispersion of the respective components in the developing material may be advantageously prevented.

For betrer understanding of the present invention, behavior of the electrically insulative fine particles, i.e. the silica fine particles employed in the developing material according to the present invention will be described hereinbelow with reference to FIGS. 1(A) to 1 (H).

Firstly, by the mixing and stirring of the electrically insulative toner particles NT and silica fine particles S, the silica fine particles S charged to the negative polarity are electrostatically attracted onto the surfaces of the toner particles NT which are charged to the positive polarity as shown in FIG. 1(A).

Subsequently, upon mixing and stirring of the toner particles NT and carrier particles MC for preparing the developing material, the toner particles NT are charged to the positive polarity, while the carrier particles MC are charged to the negative polarity through frictional contact therebetween (FIG. 1(B). Upon charging of the carrier particles MC, the silica fine particles S charged to the negative polarity and adhering to the surfaces of the toner particles NT adhere to the surfaces of the carrier particles MC charged to the negative polarity due to the large amount of the charge in the carrier particles MC, although the adhesion therebetween is not very strong as it is not due to triboelectrical charging (FIG. 1(C)). Owing to the adhesion of the silica fine particles S onto the surfaces of the carrier particles MC as described above, the charge amount of the carrier particles MC is decreased, and therefore, the silica fine particles S are again attracted towards the electrically insulative toner particles NT(FIG. 1(D)). It is to be noted here that, since the silica fine particles S and carrier particles MC are not subjected to the triboelectric charging, the amount of the silica fine particles S adhering to the carrier particles MC depends only on the charged amount of the carrier particles MC. In the state of equilibrium, the amount of charge on the developing material depends on the amount of the silica fine particles S on the carrier particles MC, and the greater the amount of the silica fine particles on the carrier particles, the smaller is the amount of charge on said carrier particles (FIG. 1(E)).

It is to be noted here that the phenomena as described above are those surmised based on the results of observations of the state of the electrostatic latent image developing material carried out by the present inventors with the use of an electron microscope. Although there might be some questions as to whether such phenomena are actually correct, the above observations generally support the view that they are, and moreover, the effects of the present invention can be clearly explained by the phenomena as described above.

More specifically, the above phenomena in which the silica fine particles S which have once adhered to the surfaces of the carrier particles MC as described with reference to FIG. 1(C), again leave said surfaces of the carrier particles MC will be analyzed more in detail hereinbelow.

In FIG. 1(F), since part of the surface of each of the carrier particles MC to which the silica fine particles S have adhered is not subjected to frictional contact with respect to the electrically insulative toner particles NT and also, is not charged by the frictional contact thereof with the silica fine particles S, said part of the surface gradually loses its charge, and after all, the silica fine particles S depart from said part of the surface. Subsequently, said part of the surface of the carrier particle MC from which the silica fine particles S have left and which has lost its charge, is again charged upon frictional contact thereof with the toner particles NT.

The phenomena as described above may be summarized as follows.

(a) The amount of the silica fine particles S to be adhered to the surface of the carrier particle MC is proportional to the size of the surface of the carrier particle MC to which the silica fine particles S have not yet adhered (i.e. the charged surface of the carrier particle MC).

(b) The amount of the silica fine particles S to leave the surface of the carrier particle MC is proportional to the amount of the silica fine particles S which have already adhered to the carrier particle MC.

More specifically, when the amount of the silica fine particles S already adhering to the carrier particles MC is large, the amount of the silica fine particles S intending to adhere to said carrier particles MC is decreased, while that leaving said carrier particles MC is increased, and consequently, the amount of the silica fine particles S adhering to said carrier particles is decreased. On the contrary, if the amount of the silica fine particles S already adhering to the carrier particles MC is small, the amount of the silica fine particles S to be adhered to said carrier particles MC is increased, while that leaving said carrier particles MC is decreased, and therefore, the amount of the silica fine particles S adhering to said carrier particles MC is increased. In other words, the state of equilibrium is thus established, with the silica fine particles S adhering to the carrier particles MC changing places with another at all times.

Before the description of EXAMPLES according to the present invention proceeds, a dry process developing apparatus to which the developing material of the present invention may be applied is briefly described hereinbelow with reference to FIG. 2.

Figure 2:
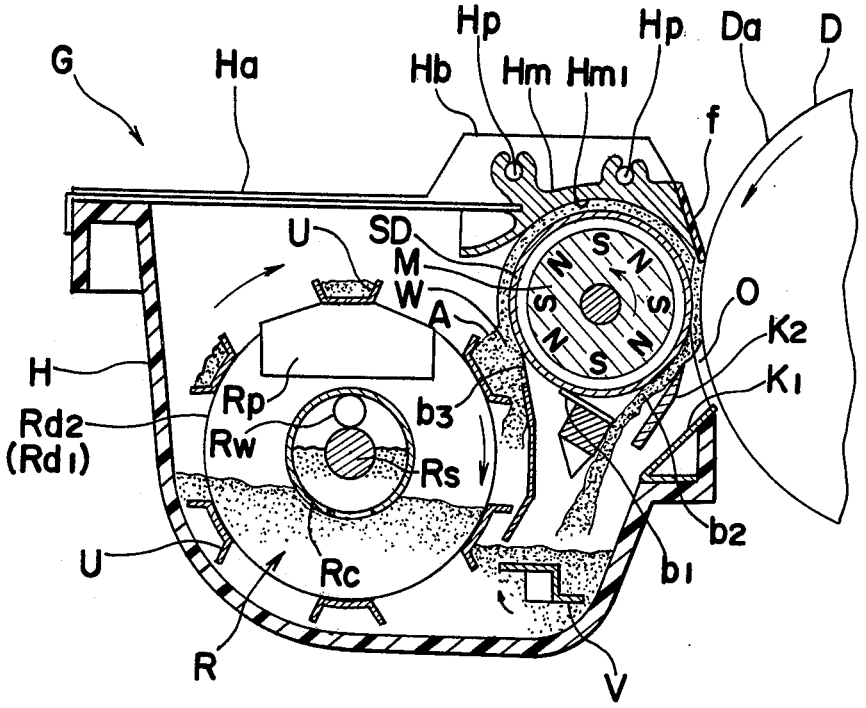
FIG. 2 is a schematic side sectional view of a developing apparatus to which the developing material according to the present invention is applicable.

In FIG. 2, the dry process developing apparatus G which employs the developing material prepared according to the present invention generally includes a housing or casing H extending the width of a known photoreceptor D in the form of a drum and substantially enclosed except for an opening O adjacent to the photosensitive or photoreceptor surface Da of the photoreceptor D whereat the development of electrostatic latent images formed on the photoreceptor surface Da is effected, an outer cylinder or developing sleeve SD rotatably provided in the housing H adjacent to the photoreceptor surface Da, a rotary magnet or multipolar magnet member M rotatably enclosed in the developing sleeve SD, and a developing material transport device R provided in the housing H under the developing sleeve SD, and including a rotary shaft Rs axially extending in the developing apparatus housing H, rotary discs Rd1 and Rd2 mounted on the shaft Rs, a plurality of the trough-like members U each having U-shaped cross section and axially disposed at regular intervals around the peripheral edges of the rotary discs Rd1 and Rd2 in a paddle wheel-like configuration as shown, a plurality of plate-like members Rp secured to inner surfaces of the corresponding trough-like members U, the cylinder member Rc partially surrounding the rotary shaft Rs, and a coil spring Rw spirally wound around the rotary shaft Rs within the cylinder member Rc so as to function as a developing material transport member. A developing material supplying device (not shown) is disposed above a cylinder member Rc of the developing material transport device R for replenishing toner into the developing apparatus G.

The developing sleeve SD of cylindrical configuration made of non-magnetizable electrically conductive material such as aluminum is disposed for rotation counterclockwise, for example, at approximately 30.2 r.p.m. in a position close to the surface Da of the phtoreceptor D which is also capable of rotating counterclockwise. The multipolar magnet member M of roll-like configuration has magnetic poles N and S sequentially arranged around its outer periphery at alternately different polar orientation as shown and is adapted to rotate at a speed of 1,300 r.p.m. in the same direction as that of the developing sleeve SD. More specifically, the developing material W is subjected to moving force in the counterclockwise direction by the rotation of the developing sleeve SD and in the clockwise direction by the magnet member M, and consequently is moved over the developing sleeve SD in the clockwise direction by the difference of revolutions between the developing sleeve SD and the magnet member M. The housing H further includes side walls Hb and an upper wall Ha above and adjacent to the developing sleeve SD, and a casing member Hm forming a part of the upper casing Ha and held in position by pins Hp and the forward end of said upper casing Ha, while the inner peripheral surface Hm1 of the casing member Hm is formed into an arcuate cross section for contact with the magnetic brush to be formed on the developing sleeve SD. Moreover, at the forward end of the casing member Hm and on an extension of the arc of the inner peripheral surface Hm1 thereof, a resilient insulative sealing member f is disposed to contact the surface Da of the photoreceptor drum D. On the other hand, below the developing sleeve SD, there are provided a developing material spilling prevention plate K1 fixed to one edge of the housing H, a developing material scattering prevention plate K2, an auxiliary cleaner blade b1 and a developing material scraper b2 respectively arranged to contact the developing sleeve SD in the direction against and following the rotation of the developing sleeve SD, another cleaner blade b3 disposed to contact the developing sleeve SD in the direction against the rotation thereof, and a developing material feeding vane V rotatably disposed for clockwise rotation.

The developing material W successively and continuously brought up to a position A to be influenced by the moving force due to the rotation of the magnet member M by trough-like members U of the developing material transport device R is moved from the position A over the developing sleeve SD in the form of the magnetic brush in the clockwise direction so as to rub against the electrostatic latent image formed on the surface Da of the photoreceptor drum D in a known manner for the development of said latent image. The developing material W after the development is scraped off the developing sleeve SD by the scraper b2 and further fed into the trough-like members U of the developing material transport device R through rotation of the feeding vane V.

Since the above developing apparatus G is described in greater detail in the copending U.S. application No. 76,955, filed on Sept. 19, 1979 and assigned to the same assignee as the present application, reference should be made thereto for further details thereof.

Hereinbelow, EXAMPLES are inserted for the purpose of illustrating the present invention, without any intention of limiting the scope thereof.

EXAMPLE 1

100 weight parts of styrene-acryl copolymer resin PLIOLITE ACL (name used in trade and manufactured by Goodyear Chemical Co., U.S.A.), 100 weight parts of tri-iron tetroxide MAPICO BLACK BL-500 (name used in trade and manufactured by Chitan Kogyo Co., Ltd., Japan), and 5 weight parts of carbon black MA #100 (name used in trade and manufactured by Mitsubishi Kasei Co., Ltd., Japan) were sufficiently kneaded by a known three-roll mill, and after crushing by an ordinary method, classified to obtain carrier particles having average particle diameter of 16 μm and volume resistance of $10^{14}$ Ω.cm.

Apart from the above, 100 weight parts of styrene-acryl copolymer resin PICCOLASTIC D-125 (name used in trade and manufactured by Esso Standard Co., U.S.A.), 8 weight parts of carbon black MA #100 (mentioned earlier), and 2 weight parts of oil black BS (name used in trade and manufactured by Orient Chemical Co., Ltd., Japan) were sufficiently kneaded by a known three-roll mill, and after crushing, classified to obtain electrically insulative toner particles having average particle diameter of 14 μm and volume resistance of $10^{15}$ Ω.cm.

0.25 weight part of electrically insulative fine particles Silica R-972 having particle diameter less than 1 μm (name used in trade and manufactured by Nippon Aerosil Co., Ltd., Japan) was added to 99.75 weight parts of the electrically insulative toner particles prepared in the above described manner, and the resultant mixture was further mixed and stirred for one hour by a known ball mill (without ball) for sufficient dispersion to prepare the replenishing developing material. 900 weight parts of the carrier particles prepared in the manner as described earlier were added to 100 weight parts of the replenishing developing material thus prepared, and the resultant mixture was further mixed and stirred by a V-mixer for about 15 hours to prepare the developing material.

By employing the developing material thus prepared, while intermittently supplying the above replenishing developing material, experimental copying was carried out by the use of a commercially available powder image transfer type electrophotographic copying apparatus equipped with the developing apparatus G having the stirring arrangement as described with reference to FIG. 2, as a result of which copied images of favorable quality were obtained even upon development of 100,000 sheets of A4 size, with the developing conditions as follows.

| | |
|---|---|
| System speed (moving speed of the photoreceptor) | 110 mm/sec. |
| Developing bias voltage | −300 V |
| Distance between the photoreceptor D and developing sleeve SD | 0.7 mm |
| Magnetic force of the magnet roller member M | 1,000 G |
| Surface potential of the photoreceptor D | |
| Image formed portion | −550 V |
| Non-image formed portion | −200 ~ −250 V |

Figure 3:
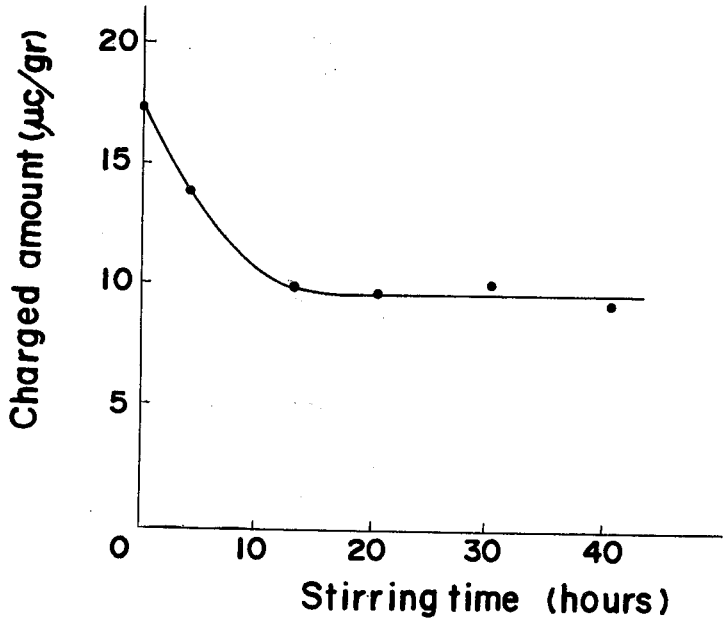
FIG. 3 is a graph showing the relationship between the amount of charge and stirring time of the developing material according to the present invention.
Figure 4:
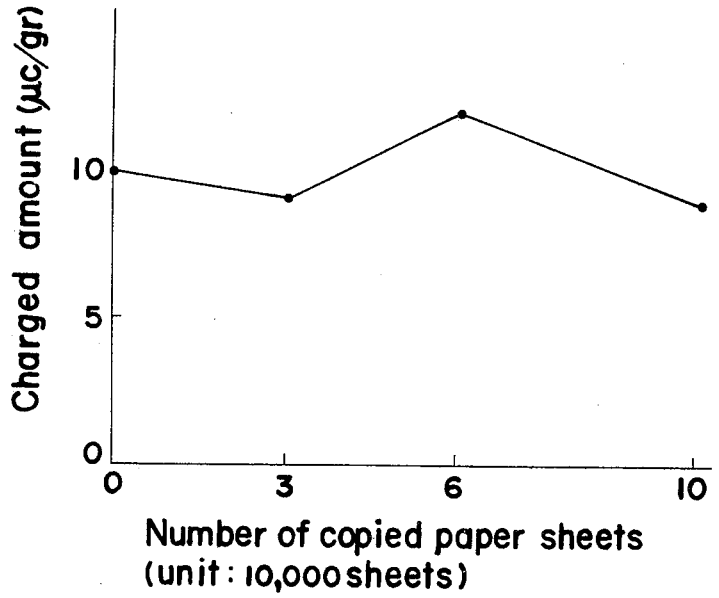
FIG. 4 is a graph showing the relationship between the amount of charge on the developing material according to the present invention and the number of copies made.

Meanwhile, in preparing the developing material as described above, the relation between the mixing time and charge amount of the developing material was investigated, with the findings as shown in a graph of FIG. 3, from which it is seen that uniform dispersion of each component is completed in about 12 hours or so when the charge amount of the developing material reaches a constant value. On the other hand, from a graph of FIG. 4 showing the relationship between the number of copied sheets taken and charge amount of the developing material, it is noticed that the developing material according to the present invention shows an approximately constant charge amount from the initial development to development after 100,000 sheets. It is to be noted here that the above charge amount was measured by maintaining approximately constant, the mixing ratio (weight ratio 1:9) of the toner particles and carrier particles in the developing material through intermittent replenishment of replenishing developing material prepared by mixing and stirring the toner particles and electrically insulative fine particles during copying of 100,000 sheets. More specifically, the replenishing amount of the replenishing developing material was set to be 105 mg at every developing of electrostatic latent image equivalent to three sheets of A4 size. From the above results also, it is understood that the developing material according to the present invention is free from the undesirable fusion of the "spent" toner onto the surfaces of the carrier particles and also the adhesion of the electrically insulative fine particles onto said surfaces of the carrier particles even during a long period of use, with a marked prolongation of its life.

Figure 5:
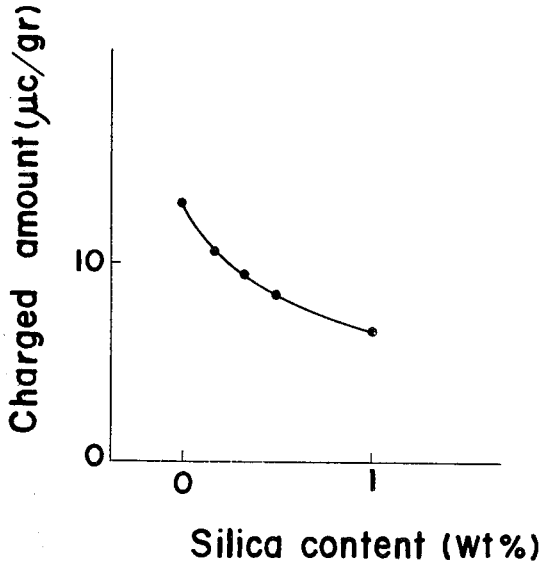
FIG. 5 is a graph showing the relationship between content of electrically insulative particles (silica) in the developing material of the present invention and the charge amount.

From a graph of FIG. 5 showing the state of variation of charge amounts upon alteration of silica content in the developing material as described above, in which each of the charge amounts is represented by the value after stirring for 10 hours, it is noticed that the charge amount decreases as the silica content increases, and therefore, the charge amount of the developing material can be controlled to the desired value through adjustment of the amount of silica to be added within the range of 0.05 to 1.0 with respect to 100 of the toner particles in weight ratio.

EXAMPLE 2

100 weight parts of styrene-acryl copolymer resin HYMER-SBM 73 (name used in trade and manufactured by Sanyo Chemical Industries, Ltd., Japan), 200 weight parts of tri-iron tetroxide RB-BL (name used in trade and manufactured by Chitan Kogyo Co., Ltd., Japan), 4 weight parts of carbon black MA #100 (mentioned earlier) were treated in the similar manner as in EXAMPLE 1 to obtain carrier particles having average particle diameter of 21 μm and volume resistance of $10^{13}$ Ω.cm.

By employing the carrier particle thus prepared, and the toner particles and silica prepared in EXAMPLE 1, the three-component developing mterial having the same mixing ratio as the developing material of EXAMPLE 1 was prepared by the same procedures and conditions as in EXAMPLE 1 for similar copying test, and the results obtained were generally the same as those in EXAMPLE 1.

EXAMPLE 3

100 weight parts of styrene-acryl copolymer resin PLIOLITE ACL (mentioned earlier), and 200 weight parts of tri-iron tetroxide MAPICO BLACK BL-500 (mentioned earlier) were treated in the similar manner as in EXAMPLE 1 to obtain carrier particles having average particle diameter of 16 μm and volume resistance of $1\times10^{14}$Ω.cm.

Apart from the above, 100 weight parts of styrene resin PICCOLASTIC E-125 (name used in trade and manufactured by Esso Standard Co., U.S.A.), 8 weight parts of carbon black KETCHEN BLACK (name used in trade and manufactured by the Lion Yushi Co., Ltd., Japan), and 2 weight parts of oil black, nigrosine base EX (name used in trade and manufactured by Orient Chemical Co., Ltd., Japan) were treated in the similar manner as in EXAMPLE 1 to obtain electrically insulative toner particles having average particle diameter of 14 μm and volume resistance of $10^{15}$Ω.cm.

By employing the carrier particles and toner particles thus prepared and silica fine particles used in EXAMPLE 1, three-component developing material having the same mixing ratio as the developing material of EXAMPLE 1 was obtained. Upon copying by using the developing material thus prepared with the copying apparatus as described in EXAMPLE 1, resuls equal to those in the developing material of EXAMPLE 1 were obtained.

Comparative experiment 1

Iron particles having average particle diameter of 80 μm were employed as carrier particles, and three-component comparative developing material was prepared by mixing and stirring by a V mixer for 5 hours, 4 weight parts of a mixture obtained by mixing and stirring the toner particles and silica fine particles of EXAMPLE 1 at the weight ratio of 99.5:0.5, and 100 weight parts of the iron particles. When copying was carried out by the use of the developing material thus prepared with the copying apparatus as employed in EXAMPLE 1, although copied sheets with favorable image quality were obtained at the initial stage, the image density was slightly reduced upon copying of 10,000 sheets, and at 20,000 sheets, fogging became conspicuous, with a marked reduction of the image density, thus only providing copied items unsuitable for actual application. Meanwhile, upon mixing and stirring, with 0.5 weight parts of silica added to the above carrier particles, it was observed that the silica particles were perfectly dispersed in one hour, while the silica particles and iron particles were subjected to triboelectric charging.

Comparative experiment 2

With employment of 100 weight parts of styrene-acryl copolymer resin, PLIOLITE ACL (mentioned earlier), 100 weight parts of tri-iron tetroxide, MAPICO BLACK BL-100 (name used in trade and manufactured by Chitan Kogyo Co., Ltd., Japan), and 5 weight parts of carbon black, MA #100 (mentioned earlier), and 5 weight parts of oil black, Oil black BS (mentioned earlier) as raw materials, carrier particles having average particle diameter of 23 μm and volume resistance of $2\times10^{14}$Ω.cm were prepared in the similar manner as in EXAMPLE 1.

Apart from the above, by employing 100 weight parts of styrene resin, PICCOLASTIC E-125 (name used in trade and manufactured by Esso Standard Co., U.S.A.), 8 weight parts of carbon black, KETCHEN BLACK EC (mentioned earlier), and 2 weight parts of metallic dye, CR-20 (name used in trade and manufactured by Orient Chemical Co., Ltd., Japan), electrically insulative toner particles having average particle diameter of 11 μm were prepared in the similar manner as EXAMPLE 1.

Subsequently, three-component developing material was prepared in the similar manner as in EXAMPLE 1 with the use of 10 weight parts of a mixture obtained by mixing and stirring for one hour, the toner particles thus obtained and silica fine particles R-972 (mentioned earlier) at the weight ratio of 99.5:0.05, and 90 weight parts of carrier particles.

Upon copying with the use of the developing material thus prepared by a copying apparatus which is same as the copying apparatus employed in EXAMPLE 1 except that the polarity of the developing bias and that of the surface potential of the photoreceptor are reversed, although favorable copied images were obtained at the initial stage, fogging and reduction reduction of image density became conspicuous at copying of 20,000 sheets, thus providing copied items unsuitable for actual application. In the above case, it was observed that the toner particles were negatively charged and carrier particles were positively charged respectively, and that, although the silica fine particles were not triboelectrically charged with respect to the toner particles, they were subjected to triboelectrical charging with respect to the carrier particles so as to be readily dispersed into carrier particles.

EXAMPLE 4

With respect to the carrier particles and toner particles prepared in the Comparative experiment 2, alumina fine particles $Al_2O_3$-C (manufactured by Nippon Aerosil Co., Ltd., Japan) having particle diameter less than 1 μm were added as the electrically insulative fine particles. It is to be noted here that in the above case, although the alumina fine particles are triboelectrically charged with respect to the toner particles (the toner particles are negatively charged, while alumina fine particles are positively charged) so as to be readily dispersed, they are not subjected to triboelectric charging with respect to the carrier particles.

With the employment of the carrier particles, toner particles and alumina fine particles as described above, three-component developing material was prepared in the similar manner as in EXAMPLE 1 and used for developing positive electrostatic latent images by the copying apparatus employed in the Comparative experiment, as a result of which copied images with favorable image quality were obtained even in copying of a large number of sheets.

Although the present invention has been fully described by way of examples with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A developing method for use in repetitive electrophotography which comprises the steps of:

(1) stirring a developing material which comprises:

(a) electrically insulative toner particles comprising colorant and resin and having a volume resistance of above $10^{14}\Omega$.cm, an average particle diameter of 2 to 30 $\mu$m, (b) carrier particles comprising magnetizable particles of average particle diameter of less than 3 $\mu$m and a bonding material, said carrier particles having a volume resistance higher than $10^{12}\Omega$.cm and an average particle diameter of 5 to 40 $\mu$m, and (c) electrically insulative fine particles composed of metallic oxide and having an average particle diameter of less than 0.1 $\mu$m, whereby components (a), (b) and (c) contact each other and whereby said carrier particles are triboelectrically charged to a polarity opposite that of said electrically insulative toner particles through frictional contact therewith, said electrically insulative fine particles are triboelectrically charged to a polarity opposite that of the electrically insulative toner particles through frictional contact therewith and wherein said fine particles are not triboelectrically charged upon frictional contact with said carrier particles, to thereby produce a triboelectrically charged developing material in which said carrier particles and said electrically insulative fine particles are charged to the same polarity, which polarity is opposite that of said electrically insulative toner particles, (2) developing electrostatic latent images into visible images with said electrically insulative toner particles and said electrically insulative fine particles contained in said developing material by:

(a) forming a magnetic brush with said developing material, (b) bringing said magnetic brush into sliding contact with said electrostatic latent images, and (3) repeating said developing step while replenishing said developing material which has been consumed, with a replenishing developing material composed of said electrically insulative toner particles and said electrically insulative fine particles.

2. The method according to claim 1 wherein said metallic oxide is silica.

3. The method according to claim 1 wherein the magnetizable material is magnetite, ferrite, or pure iron, and the bonding material is a thermoplastic or thermosetting resin.

4. The method according to claim 1 wherein the magnetizable powder is present in the carrier at 67 to about 300 weight parts, per 100 weight parts of bonding material.

5. The developing material according to claim 1 wherein the carrier further comprises a charge control or electrical resistance control agent.

6. The method according to claim 5 wherein the resistance control agent is carbon and is present at less than 15 weight parts per 100 weight parts of bonding agent.

7. The method according to claim 6 wherein the toner particles comprise carbon black and a dye as the colorant.

* * * * *